United States Patent [19]

Sargent Clement D.

[11] Patent Number: 4,675,930

[45] Date of Patent: Jun. 30, 1987

[54] SUPPORT CUSHION

[75] Inventor: Sargent Clement D., Rye, N.Y.

[73] Assignee: Theracom Corporation, Rye, N.Y.

[21] Appl. No.: 866,020

[22] Filed: May 21, 1987

[51] Int. Cl.[4] ..... A47C 27/08

[52] U.S. Cl. ..... 5/458; 5/441; 5/449; 5/465

[58] Field of Search ..... 5/457, 458, 450, 441, 5/448, 449, 455, 431, 465

[56] References Cited

U.S. PATENT DOCUMENTS

| | | | |
|---|---|---|---|
| 379,827 | 3/1888 | Snavely et al. | 5/458 |
| 2,360,715 | 10/1944 | Perry | 5/458 |
| 2,390,955 | 12/1945 | McDonnell | 5/458 |
| 2,655,369 | 10/1953 | Musilli | 5/458 |
| 2,982,341 | 5/1961 | Besser | 5/458 |
| 3,205,106 | 9/1965 | Cross | 5/458 |
| 3,574,397 | 4/1971 | Norriss | 297/391 |
| 3,899,797 | 8/1975 | Gunst | 5/458 |
| 4,011,611 | 3/1977 | Lederman | 297/456 |
| 4,021,871 | 5/1977 | Wortman . | |
| 4,027,888 | 6/1977 | Wilcox | 297/284 |
| 4,031,578 | 6/1977 | Sweeney et al. . | |
| 4,139,920 | 2/1979 | Evans | 5/455 |
| 4,218,792 | 8/1980 | Kogan | 5/436 |
| 4,320,543 | 3/1982 | Dixon | 5/434 |
| 4,324,012 | 4/1982 | Cannaday | 5/432 |
| 4,328,599 | 5/1982 | Mollura | 5/458 |
| 4,513,462 | 4/1985 | Thomas | 5/442 |
| 4,535,495 | 8/1985 | Oldfield | 5/432 |
| 4,550,459 | 11/1985 | Endel et al. | 5/437 |

*Primary Examiner*—Alexander Grosz
*Attorney, Agent, or Firm*—Pennie & Edmonds

[57] ABSTRACT

A cushioning apparatus having exterior surface means which form a desired shape and define an internal cavity therein, a plurality of tension members connecting opposed portions of the exterior surface means, and a plurality of spherical pellets which substantially fill the internal cavity. External prestressing means or tension members may also be utilized for certain sizes or configurations. The apparatus may be easily conformed to a desired shape by the user for support of a body member or the like.

19 Claims, 4 Drawing Figures

SUPPORT CUSHION

TECHNICAL FIELD

The invention relates to cushions or cushioning devices and specifically to a cushion or pillow which can be easily shaped to conform to a body member for orthopedic support.

BACKGROUND ART

Various cushioning devices or pillows have been developed whereby the shape of the pillow is designed to provide support for a body member of the user. Typical examples of such pillows or cushions can be found in U.S. Pat. Nos. 4,513,462 (neck support); 3,574,397 (head support); 4,324,012 and 4,535,495 (back support); and 4,031,578, 4,218,792, 4,320,543 and 4,550,459 (head and neck support). To provide such support, these cushions were constructed and designed to conform the shape of the body part to be supported.

Conventional pillows are usually filled with a cushioning material of cotton, feathers, sponge rubber, and/or foam. The sponge or foam fillers may be in the form of chunks or particles. Such pillows can be manipulated to conform to the shape of the body part to be supported. If the construction of the pillow is too stiff, however, it becomes difficult to conform the shape of the pillow to the body part. Conversely, if the pillow is too soft, depressions are easily formed, and the proper support of the body member is not achieved. Furthermore, the shaping capabilities of such conventional pillows are rather limited. Often, the filler simply packs into a dense mass and loses its resiliency.

U.S. Pat. No. 4,021,871 discloses an improvement on the previous devices in that the internal cavity of the cushion is filled with a layer of fibrous textile filler positioned in a particular manner to provide a cushion which retains its shape more effectively and imparts improved cushioning resistance.

None of these prior art cushioning devices is capable, however, of being easily shaped to the desired configuration to provide support, while retaining sufficient resiliency to maintain the desired shape until it is changed by the user. Furthermore, if the pillow cannot be conformed the exact shape needed for support, the user can feel displeasure, discomfort, or pain.

SUMMARY OF THE INVENTION

The present invention relates to a cushioning apparatus comprising exterior surface means forming a desired shape for the apparatus and defining an internal cavity therein, means for connecting and prestressing substantially opposed portions of the exterior surface means through the internal cavity, and pellet means substantially filling the internal cavity. For certain apparatus, external prestressing means may be used in conjunction with the internal prestressing means. The exterior surface means of the apparatus may be substantially spherical in shape, with the cushoning means passing through the center of the sphere, or in the shape of a six-sided box whereby the connecting means connects opposed sides of the box. Other configurations for the exterior surface means may also be used.

The exterior surface means may be any natural or synthetic fabric, preferably a stretch fabric of a lightweight, stretchable synthetic material while the pellets are preferably made of a thermoplastic or expanded thermoplastic material. The connecting means generally comprises a plurality of flexible tension members, each spaced by a distance of between 1 and 10 inches, and preferably between 4 and 5 inches.

An alternate embodiment of the invention relates to a cushioning apparatus comprising exterior surface means forming a desired shape for the apparatus and defining an internal cavity therein, means extending through the internal cavity for maintaining the exterior surface means under tension, and a plurality of spherical particles substantially filling the internal cavity. In this arrangement, the tension maintaining means comprises a plurality of resilient, flexible tension members connecting opposed portions of the exterior surface means. Advantageously, such tension members are made of a stretchable synthetic fabric, thermoplastic, or elastomeric material in the shape of strip, rod, bar, fiber or cord.

A further embodiment of the invention relates to a lightweight cushioning apparatus comprising exterior surface means forming a desired shape for the apparatus and defining an internal cavity therein, a plurality of members connecting substantially opposed portions of the surface means through the internal cavity to maintain the surface means under tension and attempt to draw together the opposed portions of the surface means, and a plurality of expanded thermoplastic spheres substantially filling the internal cavity to retain the exterior surface means in the desired shape and provide resistance against the attempt of the tension members to draw together the opposed portions of the surface means.

BRIEF DESCRIPTION OF THE DRAWINGS

The nature, advantages, and various other additional features of the invention will appear more fully upon consideration of the illustrative embodiments now to be described in detail in connection with the accompanying drawing figures, wherein.

DETAILED DESCRIPTION OF THE PREFERRED EMBODIMENTS

Figure 1:
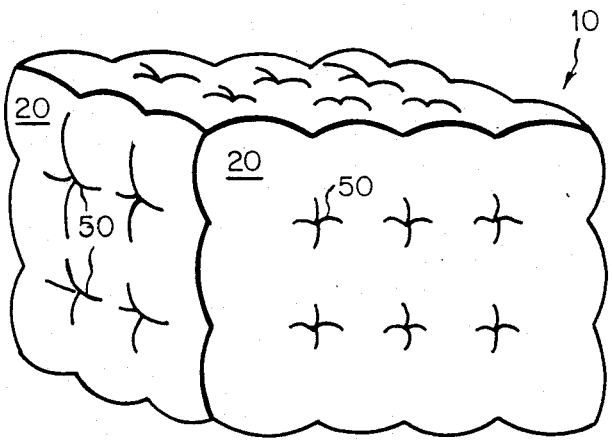
FIG. 1 is a perspective view of a support cushion according to the invention.

Referring now to FIG. 1, there is illustrated a support cushion 10 in the form of a six-sided substantially rectangular box. The exterior covering 20 of the cushion 10 can be made of any of a variety of natural or synthetic cloth or fabric materials. Preferably, the covering is made of a synthetic, elastic or stretch fabric, whether woven or knitted. When a lightweight pillow is desired, it has been found that synthetic polyester materials having good stretchability, preferably in both the X and Y directions (i.e., 2-way stretch materials), stretch retention, washability and non-allergenic properties are preferred. The optimum material for such lightweight pillows is available from Dupont under the trade name Lycra Spandex. This material is available in a variety of weights which could be selected depending upon the desired end use for the cushion.

Figure 2:
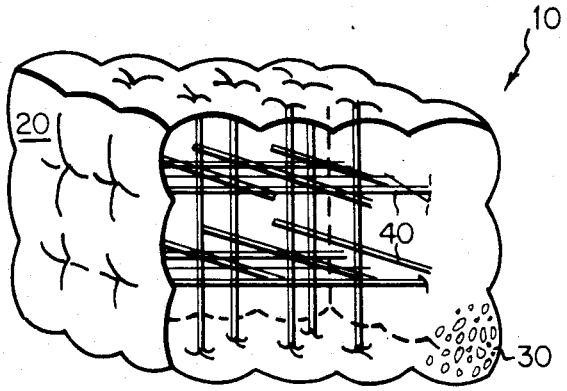
FIG. 2 is a perspective view of the cushion of FIG. 1 with a side panel removed.

FIG. 2 illustrates the cushion of FIG. 1 with a side panel removed to detail the spherical plastic foam pellets 30 and tension members 40 which are located inside. The tension members are used to pre-stress opposed faces of the exterior covering 20 while the pellets 30 prevent the opposed faces the exterior covering from being drawn together. Also, the pellets enable the user to manipulate the cushion to conform to a desired shape.

A wide variety of plastic or elastomeric foam particles or pellets are available at present and any of the generally known types are suitable for use in one embodiment of this invention. Again, for the construction of a lightweight pillow, the low density foamed materials, such as foamed or expanded polyethylene, polypropylene, polystyrene and the like, are preferred. All of the pellets used in this invention, however, should be resilient, washable, and capable of retaining their resiliency over an extended period of use and time. The smaller size pellets generally contribute to a soft cushion which can be easily manipulated to conform to a particular or desired shape, while the larger pellets produce a somewhat firmer cushion. Also, a wide range of pellet sizes can be used in the cushion without departing from the invention.

The preferred pellets for use in constructing the lightweight cushions of the present invention include any foam or expanded plastic materials in the form of spheres. The size range for such spheres is not essential to the use of the support cushion. However, it is preferred that these spheres have diameters between 1/64 and ½ inch; most preferably between 1/32 and ¼ inch. Preferred materials would again included expanded thermoplastic foams, with expanded polystyrene foam spheres being the most advantageous from the standpoint of light weight. When the pillow is filled with particles of substantially uniform diameters on the order of ¼ inch or greater, a relatively firm cushion is provided. For softer and more easily shapable cushions, it is preferred to use spheres having diameters in the range between ¼ and ⅛ inch or smaller. Particle sizes having a diameter above ½ inch are generally selected for very large cushions or mattresses which in turn may be necessary for supporting the user's entire body, or for larger objects, such as animals. Again, as noted above, different size pellets may be used to obtain cushions having the desired softness or firmness for the particular application.

Expanded or foamed thermoplastics are preferred due to their springiness, resiliency, and ultra-light weight. If spheres of these materials are compressed, they will substantially return to their original shape after the compressive force has been removed. Thus, the spheres contribute to the invention in that they are easily capable of movement or deformation to allow shaping of the cushion. If they are deformed, these spheres do return to their original configuration reasonably well after the item to be supported is removed from the pillow. In addition, the use of such expanded thermoplastics in conjunction with lightweight covering materials enables an extremely ultra lightweight overall cushion to be provided. For example, a 14"×10"×10" box-like cushion containing expanded polystyrene spheres having diameters between ⅛ and ¼ inch with Lycra Spandex outer surface material and tension members would weigh approximately 13½ ounces. This is a significant improvement in weight compared to the much heavier pillows of the prior art.

As is evident from FIG. 2, the opposed exterior surfaces 20 of the cushion 10 are pre-stressed by connecting thereto a plurality of tension members 40 in the form of elastic cord or other similar flexible connectors. Such flexible connectors can be in the form of fiber, tube, rod, bar, strip or the like: the only requirement being that they have a flexible or elastic nature which when at rest can be extended or stretched and which when stretched attempts to return to its rest position. When the user attempts to conform the cushion to a particular shape, the elastic tension members 40 are allowed to contract, thus facilitating the shaping of the cushion 10 and also maintaining the cushion in the desired shape until it is later changed to a different shape by the user.

A preferred material for these tension members is also the Lycra Spandex material referred to above. Similar materials having the ability to stretch and contract numerous times, while also being washable without losing its flexibility over time, can also be used. Various thermoplastics or elastomeric materials, including natural or synthetic latexes, are suitable for these tension members. Generally, while the solid or hollow diameter tube or rod is preferred, it is also possible to use rectangular or square cross-sectional hollow or solid bar materials or even fabric of various widths. When fabric is used, the width of the material would generally be on the order of about ¼ to ½ inch. Larger width material may be used for larger sized cushions or where additional tension force is required.

The tension members are generally spaced on 4 to 5 inch centers across the exterior surface of the cushion 10. The pattern of a spaced elastic cord attachment positions can be square, diamond shaped, centered or off-centered. The 4 to 5 inch spacing is not critical and again would be determined by the size of the cushion. Tension member spacings smaller than about 1 inch generally provide an excessive number of such members, whereas spacing of greater than 10 inches is usually insufficient to prestress the opposed surfaces, particularly in larger size cushions.

When the tension cords are attached, they are stretched and pulled relatively taut so that the outer surfaces of the pillow are maintained under tension in a pre-stressed condition. This is shown in FIGS. 1 and 2 as an indentation 50 in the surface of the exterior cover. Although each point of attachment (shown as indentation 50) normally utilizes a single tension member, it may be desirable to use 2 or more smaller size tension members for each indentation. Thus is particularly useful in large pillows where single tension members would have to be relatively large. The filling of the pillow with the expanded thermoplastic spheres 30 thus enables the cushion to maintain its normal exterior shape (i.e. round, square, rectangular, wedge etc.).

Figure 3:
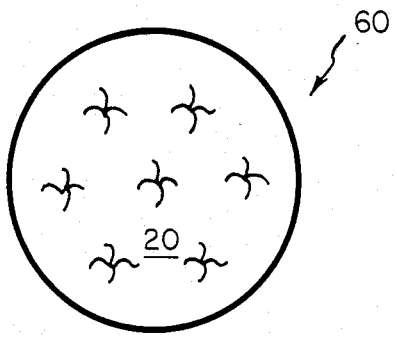
FIG. 3 is a perspective view of another support cushon according to the invention.
Figure 4:
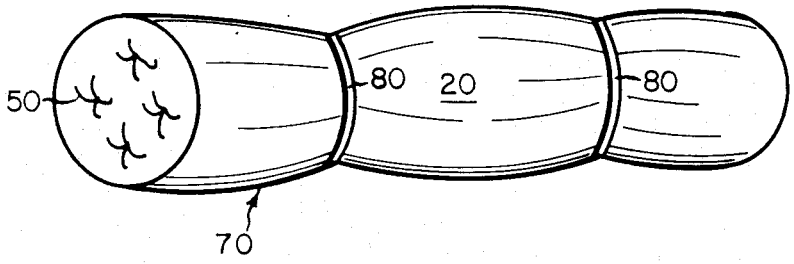
FIG. 4 is a perspective view of a support cushion having external prestressing means.

FIGS. 3 and 4 illustrate additional embodiments of support cushions according to the invention. FIG. 3 shows a spherical pillow 60 having exterior surface means 20 and a plurality of stress points or indentations 50. The tension members (not shown, but see FIG. 2) connecting these stress points all would pass through the approximate center of the sphere. In addition to use as a pillow or cushion, the spherical shape is useful as a ball or play object.

FIG. 4 shows a cylindrical pillow 70 with exterior surface 20 and indentations 50. According to a further aspect of the invention, exterior prestressing means 80, again in the form of tension cord but this time wrapped around the circumference of exterior surface 20, help hold the pillow in the shape formed by the user. The desired configuration of the particular pillow to be manufactured will determine whether such exterior prestressing means are necessary, with elongated pillows generally requiring this additional prestressing feature.

In order to use the cushion, one merely compresses the exterior surface areas to conform the cushion to the shape of the object or body member to be supported (i.e. arm, elbow, leg, shoulder, etc.). The pellets or spheres 30 easily move around each other as the tension members 40 contact, thus enabling the cushion to be easily and quickly formed to the desired shape. In the event the cushion is extremely compressed in certain areas, such as it exposed to a heavy load, the expanded thermoplastic spheres 30 are capable of being compressed to accommodate the load. Upon removal of the load, the pellets or spheres return to their original spherical shape, although the cusion itself will not return to its original configuration. Should a different configuration or shape be desired for the cushion the user must again compress or shape the cushion to the desired new configuration.

As one skilled in the art can realize, the present invention is ideally suited for arthritis sufferers, patients recovering from surgery, those suffering from backache, pain or discomfort caused by difficult pregnancies, temporary sprains, sports injuries, broken bones, or the like. One of the advantages of the cushions of this invention is that they can be adjusted to the precise shape for maximum comfort and support of the body member. Therefore, the user is able to completely relax while the body member is supported and this facilitates resting and sleeping much easier than if the body member were rested or being supported upon an uncomfortable pillow.

The size of the overall cushion is not critical to the invention. Sizes can vary from relatively small (i.e. that sufficient for supporting a head, hand or foot), to very large which, for example, can be used in place of a bed mattress for support of the entire body of the user. Although practically any shape can be used, the following have been found to be particularly useful: wedge, tube or cylinder, truncated pyramid, sphere, eggshape, box (six-sided - rectangular or square), and triangular. As noted above, the extreme light weight of the preferred embodiments enable the cushion to be easily handled, moved or shaped by the user.

While it is apparent that the invention herein disclosed is well calculated to fulfill the objects above stated, it will be appreciated that numerous embodiments and modifications may be devised by those skilled in the art, and it is intended that the appended claims cover all such modifications and embodiments as fall within the true spirit and scope of the present invention.

What is claimed is:

1. A lightweight, shapable cushioning apparatus which is easily conformable to a desired configuration for supporting an item comprising:

exterior surface means of a material stretchable in two directions for forming a desired shape for the apparatus and defining an internal cavity therein;

a plurality of elastic tension members for connecting and prestressing said exterior surface means, the ends of said members attached to the surface means and extending through said internal cavity thus forming an internal structure; and pellet means of lightweight, resilient, solid, expanded thermoplastic spheres substantially filling said internal cavity, said pellet means capable of compression, deformation and three-dimensional movement throughout the internal cavity without interference from said structure of elastic tension members to allow shaping of the apparatus for support of an item, said spheres further capable of returning to their spherical shape after the item to be supported is removed from the apparatus; said exterior surface means, tension members, and pellet means capable of easily conforming to the desired configuration while also providing softness, light weight and washability features to the apparatus.

2. The apparatus of claim 1 which further comprises external means for prestressing said exterior surface means.

3. The apparatus of claim 1 wherein each flexible tension member is spaced a distance between 1 and 10 inches from adjacent tension members.

4. The apparatus of claim 3 wherein the distance between each tension member is between 4 and 5 inches.

5. The apparatus of claim 1 wherein a majority of said spheres have a diameter of between about 1/64 and ½ inch.

6. The apparatus of claim 1 wherein at least two of said elastic tension members of said network cross each other at an angle.

7. A lightweight, shapable cushioning apparatus which is easily conformable to a desired configuration for supporting an item comprising:

exterior surface means of a fabric which is stretchable in two directions for forming a desried shape for the apparatus and defining an internal cavity therein;

a plurality of elastic tension members extending through said internal cavity for forming a structure and maintaining said exterior surface means under tension, the ends of said members attached to said surface means; and a plurality of lightweight, resilient, solid, expanded spherical thermoplastic particles substantially filling said internal cavity, said particles capable of compression, deformation and three-dimensional movement through the internal cavity without interference from the structure of elastic tension members to allow shaping of the apparatus for support of an item, said particles further capable of returning to their spherical shape after the item to be supported is removed from the apparatus; said exterior surface means, tension members, and particles capable of easily conforming to the desired configuration while also providing softness, lightweight and washability features to the apparatus.

8. The apparatus of claim 7 wherein said elastic tension members comprise a stretchable material in the shape of one of fiber, strip, tube, bar, or cord.

9. The apparatus of claim 7 wherein a majority of said particles have a diameter of between about 1/64 and ½ inch.

10. The apparatus of claim 7 wherein at least two of said elastic tension members of said network cross each other at an angle.

11. A lightweight, shapable cushioning apparatus which is easily conformable to a desired configuration for supporting an item comprising:

exterior surface means of a flexible, fabric material stretchable in two directions for forming a desried shape for the apparatus and defining an internal cavity therein;

a plurality of elastic tension members attached to and connecting portions of said surface means through said internal cavity to form a structure which maintains said surface means under tension, said members attempting to draw together said portions of said surface means;

a plurality of lightweight, resilient, solid expanded thermoplastic spheres substantially filling said internal cavity to retain said exterior surface means in the desired shape and provide resistance against the attempt of said surface means connecting tension members to draw together said portions of said surface means, said sphere means capable of reversible compression, deformation and three-dimensional movement throughout the internal cavity without interference from said structure of elastic tension members to allow shaping of the apparatus for support of an item, said spheres further capable of returning to their spherical shape after the item to be supported is removed from the apparatus; and external means for prestressing said exterior surface means; said exterior surface means, tension members, spheres and external means capable of easily conforming to the desired configuration while also providing softness, lightweight and washable features to the apparatus.

12. The apparatus of claim 11 wherein each of said surface means connecting tension members comprises a stretchable, synthetic material.

13. The apparatus of claim 12 wherein each surface means connecting tension members is in the form of one of fiber or cord and spaced by a distance of between 4 and 5 inches from adjacent tension members.

14. The apparatus of claim 11 wherein the expanded thermoplastic spheres are made of polystyrene.

15. The apparatus of claim 11 wherein a majority of said spheres have a diameter of between about 1/64 and ½ inch.

16. A lightweight, shapable cushioning apparatus which is easily conformable to a desired configuration for supporting an item comprising:

exterior surface means of a flexible, fabric material stretchable in two directions for forming a desired shape for the apparatus and defining an internal cavity therein;

a plurality of elastic tension members attached to and connecting portions of said surface means through said internal cavity to form a structure which maintains said surface means under tension, said members attempting to draw together said portions of said surface means, at least two of said members of said structure crossing each other at a angle; and a plurality of lightweight, resilient, solid expanded thermoplastic spheres substantially filling said internal cavity to retain said exterior surface means in the desired shape and provide resistance against the attempt of said surface means connecting tension members to draw together said portions of said surface means, said sphere means capable of compression, deformation and movement to allow shaping of the apparatus for support of an item yet further capable of returning to their spherical shape after the item to be supported is removed from the apparatus.

17. The apparatus of claim 16 wherein said elastic members comprise one of a stretchable fabric, a thermoplastic material, or an elastomeric material.

18. The apparatus of claim 16 wherein a majority of said spheres have a diameter of between about 1/64 and ½ inch.

19. The apparatus of claim 16 which further comprises external means for prestressing said exterior surface means.

* * * * *